US007767371B2

(12) United States Patent
Bender et al.

(10) Patent No.: US 7,767,371 B2
(45) Date of Patent: Aug. 3, 2010

(54) IMAGING MEMBER HAVING HIGH CHARGE MOBILITY

(75) Inventors: Timothy P. Bender, Toronto (CA); Gregory McGuire, Oakville (CA)

(73) Assignee: Xerox Corporation, Norwalk, CT (US)

( * ) Notice: Subject to any disclaimer, the term of this patent is extended or adjusted under 35 U.S.C. 154(b) by 1028 days.

(21) Appl. No.: 11/502,304

(22) Filed: Aug. 10, 2006

(65) Prior Publication Data

US 2008/0063961 A1 Mar. 13, 2008

(51) Int. Cl.
*G03G 5/02* (2006.01)

(52) U.S. Cl. ..... 430/58.75; 430/58.85

(58) Field of Classification Search ..... 430/58.75, 430/58.85

See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 4,286,033 | A | 8/1981 | Neyhart et al. | |
| 4,338,387 | A | 7/1982 | Hewitt | |
| 4,587,189 | A | 5/1986 | Hor et al. | |
| 4,664,995 | A | 5/1987 | Horgan et al. | |
| 4,988,597 | A | 1/1991 | Spiewak et al. | |
| 5,244,762 | A | 9/1993 | Spiewak et al. | |
| 5,756,245 | A | 5/1998 | Esteghamatian et al. | |
| 7,527,905 | B2 * | 5/2009 | Yu | 430/64 |
| 2007/0134573 | A1 * | 6/2007 | Yanus et al. | 430/66 |

OTHER PUBLICATIONS

Melnyk and Pai, "Transient Photoconductivity Measurements," Determination of electronic and Optical Properties, 2nd ed., John Wiley & Sons, Inc., p. 321-386, (1993).

* cited by examiner

*Primary Examiner*—John L Goodrow
(74) *Attorney, Agent, or Firm*—Pillsbury Winthrop Shaw Pittman LLP

(57) ABSTRACT

The presently disclosed embodiments are directed to charge transport layers useful in electrostatography. More particularly, the embodiments pertain to an electrostatographic imaging member comprising a charge transport layer that exhibits improved charge mobility transport.

20 Claims, 3 Drawing Sheets

IMAGING MEMBER HAVING HIGH CHARGE MOBILITY

BACKGROUND

The presently disclosed embodiments relate generally to layers that are useful in imaging apparatus members and components, for use in electrostatographic, including digital, apparatuses. More particularly, the embodiments pertain to an improved electrostatographic imaging member with a charge transport layer comprising a high charge mobility composite comprising a transport molecule dispersed in a charge transport polymer. The charge transport layer exhibits improved charge mobility.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrophotographic imaging members may include photosensitive members (photoreceptors) which are commonly utilized in electrophotographic (xerographic) processes, in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam. These electrophotographic imaging members comprise a photoconductive layer comprising a single layer or composite layers.

The term "electrostatographic" is generally used interchangeably with the term "electrophotographic." The term "photoreceptor" is generally used interchangeably with "imaging member." In addition, the terms "charge blocking layer" and "blocking layer" are generally used interchangeably with the phrase "undercoat layer."

One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

In the case where the charge-generating layer (CGL) is sandwiched between the CTL and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of CGL layer is charged positively while conductive layer is charged negatively and the holes are injected through from the CGL to the CTL. The CTL should be able to transport the holes with as little trapping of charge as possible. In flexible web like photoreceptor the charge conductive layer may be a thin coating of metal on a thin layer of thermoplastic resin.

One type of multilayered photoreceptor that has been employed as a belt in electrophotographic imaging systems comprises a substrate, a conductive layer, an optional blocking layer, an optional adhesive layer, a CGL, a CTL and a conductive ground strip layer adjacent to one edge of the imaging layers, and an optional overcoat layer adjacent to another edge of the imaging layers. Such a photoreceptor may further comprise an anti-curl backing layer on the side of the substrate opposite the side carrying the conductive layer, support layer, blocking layer, adhesive layer, CGL, CTL and other layers. In a typical machine design, a flexible imaging member belt is mounted over and around a belt support module comprising numbers of belt support rollers, such that the top outermost charge transport layer is exposed to all electrophotographic imaging subsystems interactions.

As electrophotography advances, there is a continued need for increasing the speed at which electrophotographic machines can operate. The complex, highly sophisticated duplicating systems need to operate at very high speeds which places stringent requirements including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images at high speeds over many thousands of cycles.

Current photoreceptors move charge across the layers in roughly the same amount of time as there is between the expose and development stations, for example, approaching a speed of 200 ppm. Thus, it is desirable to increase the speed at which a photoreceptor can discharge in order to gain latitude below 200 ppm or in order to penetrate the 200 ppm level.

SUMMARY

According to aspects illustrated herein, there is provided a charge transport layer that addresses the shortcomings of current photoreceptors or imaging members discussed above. These compositions and processes described herein relate to a mechanically robust charge transport layer, comprising a high charge mobility composite, that exhibits a substantial increase in the speed at which the imaging member is able to move charge across.

An embodiment may include an electrostatographic imaging member comprising a substrate, a charge generating layer disposed on the substrate, and at least one charge transport layer disposed on the charge generating layer, the at least one charge transport layer comprising a high charge mobility composite comprising a terphenyl-based arylamine, and a hole-transporting polymer.

A further embodiment may include an imaging member comprising a substrate, a charge generating layer disposed on the substrate, and at least one charge transport layer disposed on the charge generating layer, the at least one charge transport layer comprising a high charge mobility composite comprising a terphenyl-based arylamine having the following formula:

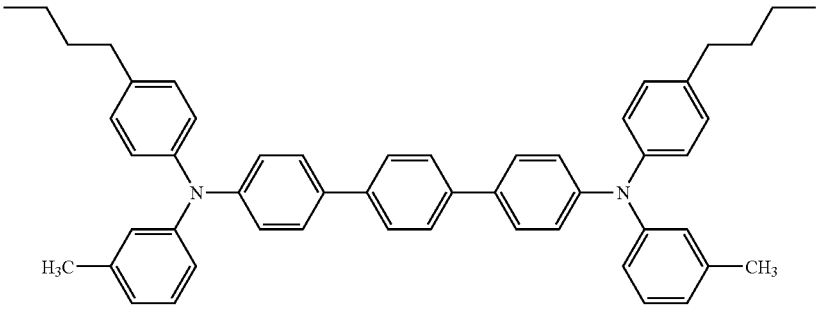

and a hole-transporting polymer based on dihydroxy-TBD, N,N'-(3-hydroxyphenyl)-N,N'-diphenylbenzidine.

In still another embodiment, there is provided an image forming apparatus for forming images on a recording medium comprising an imaging member having a charge retentive surface for receiving an electrostatic latent image thereon, wherein the imaging member comprises a substrate, a charge generating layer disposed on the substrate, and at least one charge transport layer disposed on the charge generating layer, the at least one charge transport layer comprising a high charge mobility composite comprising a terphenyl-based arylamine, and a hole-transporting polymer; a development component for applying a developer material to the charge-retentive surface to develop the electrostatic latent image to form a developed image on the charge-retentive surface; a transfer component for transferring the developed image from the charge-retentive surface to a copy substrate; an a fusing component for fusing the developed image to the copy substrate.

BRIEF DESCRIPTION OF THE DRAWINGS

For a better understanding, reference may be had to the accompanying figures.

DETAILED DESCRIPTION

Figure 1:
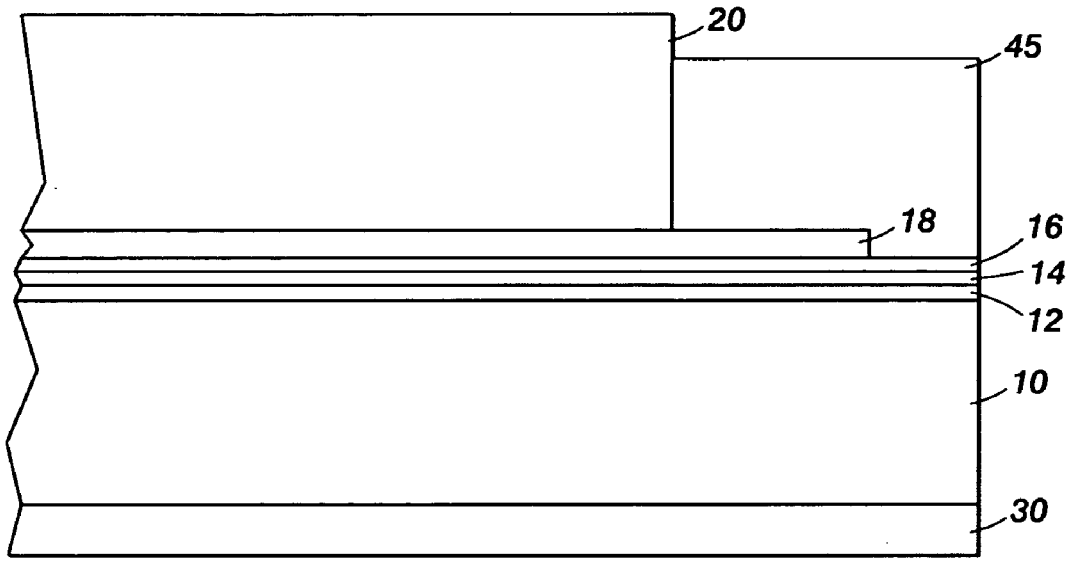
FIG. 1 is a cross-sectional view of a multilayered electrophotographic imaging member where the charge transport layer is a single layer according to one embodiment.

In the following description, reference is made to the accompanying drawings, which form a part hereof and which illustrate several embodiments. It is understood that other embodiments may be utilized and structural and operational changes may be made without departure from the scope of the present disclosure.

The presently disclosed embodiments are directed generally to layers useful in imaging apparatus components, such as an imaging member, that exhibit high charge mobility across the layers. In a typical electrostatographic reproducing or digital printing apparatus using a photoreceptor, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on an electrostatographic imaging member which has a charge-retentive surface. The developed toner image can then be transferred to a copy substrate, such as paper, that receives the image via a transfer member.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

An exemplary embodiment of a multilayered electrophotographic imaging member of flexible belt configuration is illustrated in FIG. 1. The exemplary imaging member includes a support substrate 10 having an optional conductive surface layer or layers 12 (which may be referred to herein as a ground plane layer), optional if the substrate itself is conductive, a hole blocking layer 14, an optional adhesive interface layer 16, a charge generating layer 18 and a charge transport layer 20. The charge generating layer 18 and the charge transport layer 20 forms an imaging layer described here as two separate layers. It will be appreciated that the functional components of these layers may alternatively be combined into a single layer.

Other layers of the imaging member may include, for example, an optional ground strip layer 45, applied to one edge of the imaging member to promote electrical continuity with the conductive layer 12 through the hole blocking layer 14. An anti-curl backing layer 30 of the photoreceptor may be formed on the backside of the support substrate 10. The conductive ground plane 12 is typically a thin metallic layer, for example a 10 nanometer thick titanium coating, deposited over the substrate 10 by vacuum deposition or sputtering process. The layers 14, 16, 18, and 20 may be separately and sequentially deposited on to the surface of conductive ground plane 12 of substrate 10 as solutions comprising a solvent, with each layer being dried before deposition of the next. The ground strip layer 45 may be applied after coating these layers or simultaneously with the CTL.

The multilayered, flexible electrophotographic imaging member web stocks fabricated in accordance with the embodiments described herein may be cut into rectangular sheets. Each cut sheet is then brought overlapped at the ends and joined by any suitable means, such as ultrasonic welding, gluing, taping, stapling, or pressure and heat fusing to form a continuous imaging member seamed belt, sleeve, or cylinder.

For reasons of convenience, the present disclosure is described for electrophotographic imaging members in flexible belt form even though electrostatographic imaging members having similar configurations are also included.

Figure 2:
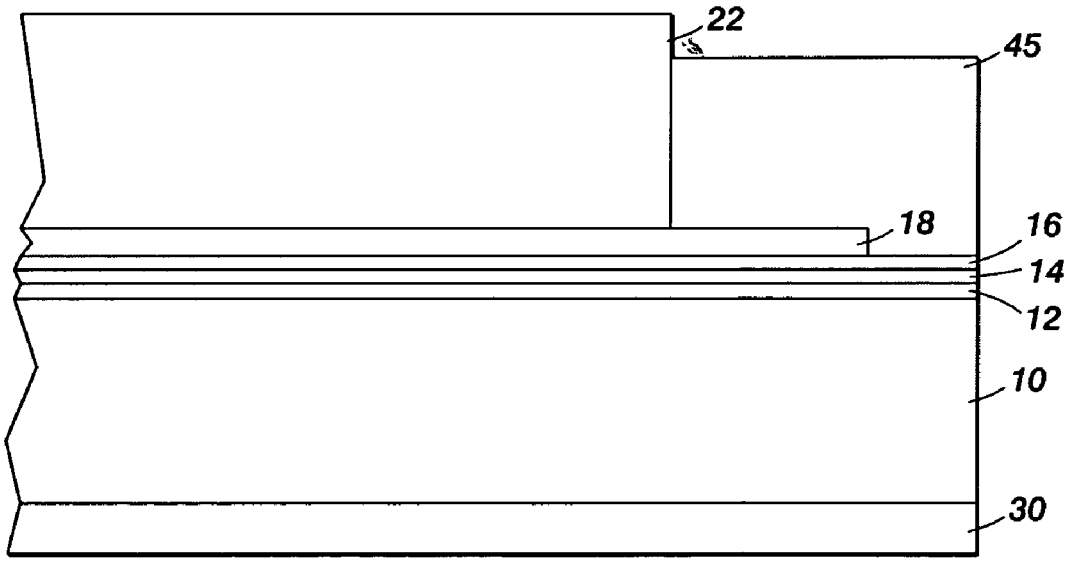
FIG. 2 is a cross-section view of a multilayered electrophotographic imaging member according to another embodiment.

As an alternative to separate charge transport 20 and charge generation layers 18, a single imaging layer 22 may be employed, as shown in FIG. 2, with other layers of the photoreceptor being formed as described below. The imaging layer 22 may comprise a single electrophotographically active layer capable of retaining an electrostatic charge in the dark during electrostatic charging, imagewise exposure and image development. The single imaging layer 22 may include charge transport molecules in a binder, similar to those of the charge transport layer 20 and optionally may also include a charge generating/photoconductive material, similar to those of the layer 18 described below.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, the belt can be seamed or seamless.

The thickness of the substrate 10 depends on numerous factors, including flexibility, mechanical performance, and economic considerations. The thickness of the support substrate 10 may range from about 25 micrometers to about 3,000 micrometers. In embodiments of flexible photoreceptor belt preparation, the thickness of substrate 10 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support 10 is not soluble in any of the solvents used in each coating layer solution, is optically transparent or semi-transparent, and is thermally stable up to a high temperature of about 150° C. A typical substrate support 10 used for imaging member fabrication has a thermal contraction coefficient ranging from about $1\times10^{-5}$ per ° C. to about $3\times10^{-5}$ per ° C. and a Young's Modulus of between about $5\times10^{5}$ psi ($3.5\times10^{-4}$ Kg/cm$^2$) and about $7\times10^{-5}$ psi ($4.9\times10^{-4}$ Kg/cm$^2$).

The Conductive Layer

The conductive ground plane layer 12 may vary in thickness depending on the optical transparency and flexibility desired for the electrophotographic imaging member. When a photoreceptor flexible belt is desired, the thickness of the conductive layer 12 on the support substrate 10, for example, a titanium and/or zirconium conductive layer produced by a sputtered deposition process, typically ranges from about 2 nanometers to about 75 nanometers to allow adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer 12 may be an electrically conductive metal layer which may be formed, for example, on the substrate by any suitable coating technique, such as a vacuum depositing or sputtering technique. Typical metals suitable for use as conductive layer 12 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface can perform the function of an electrically conductive layer and a separate electrical conductive layer may be omitted. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 12 comprising an electrically conductive material, such as titanium or titanium/zirconium, coating over the substrate layer 10.

The Hole Blocking Layer

An optional hole blocking layer 14 may then be applied to the substrate 10 or to the layer 12, where present. Any suitable positive charge (hole) blocking layer capable of forming an effective barrier to the injection of holes from the adjacent conductive layer 12 into the photoconductive or charge generating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer should be continuous and may have a thickness in a wide range of from about 0.2 microns to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl) methyl diethoxysilane which has the formula $[H_2N(CH_2)_4]CH_3Si(OCH_3)_2$, and (gamma-aminopropyl) methyl diethoxysilane, which has the formula $[H_2N(CH_2)_3]CH_{33}Si(OCH_3)_2$, and combinations thereof, as disclosed, for example, in U.S. Pat. Nos. 4,338,387; 4,286,033; and 4,291,110, incorporated herein by reference in their entireties. An embodiment of a hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate).

The blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. In yet other embodiments, the adhesive interface layer 16 is entirely omitted.

Any suitable solvent or solvent mixtures may be employed to form a coating solution of the polyester for the adhesive interface layer 16. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The charge generating layer 18 may thereafter be applied to the adhesive layer 16. Any suitable charge generating binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous charge generating layer. Benzimidazole perylene compositions are well known and described, for example, in U.S. Pat. No. 4,587,189, the entire disclosure thereof being incorporated herein by reference. Multi-charge generating layer compositions may be utilized where a photoconductive layer enhances or reduces the properties of the charge generating layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, from about 5 percent by volume to about 90 percent by volume of the charge generating material is dispersed in about 10 percent by volume to about 95 percent by volume of the resinous binder, and more specifically from about 20 percent by volume to about 60 percent by volume of the charge generating material is dispersed in about 40 percent by volume to about 80 percent by volume of the resinous binder composition.

The charge generating layer 18 containing the charge generating material and the resinous binder material generally ranges in thickness of from about 0.1 micrometer to about 5 micrometers, for example, from about 0.3 micrometers to about 3 micrometers when dry. The charge generating layer thickness is generally related to binder content. Higher binder content compositions generally employ thicker layers for charge generation.

The Charge Transport Layer

The charge transport layer 20 is thereafter applied over the charge generating layer 18 and may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generating layer 18 is sandwiched between the substrate and the charge transport layer 20. The charge transport layer 20 in conjunction with the charge generating layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments electrically inactive binders are comprised of polycarbonate resins with for example a molecular weight of from about 20,000 to about 100,000 and more specifically with a molecular weight $M_w$ of from about 50,000 to about 100,000. Examples of polycarbonates are poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyldiphenyl)carbonate (also referred to as bisphenol-C-polycarbonate) and the like. In embodiments, the charge transport layer, such as a hole transport layer, may have a thickness from about 10 to about 55 microns.

The charge transport layers can comprise in embodiments aryl amine molecules, and other known charge components. For example, a photoconductive imaging member disclosed herein may have charge transport aryl amines of the following formula:

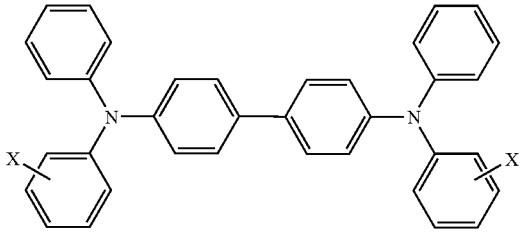

wherein x is alkyl, and wherein the aryl amine is dispersed in a resinous binder. In another embodiment, imaging member may have an aryl amine wherein x is methyl, a halogen that is chloride, and a resinous binder selected from the group consisting of polycarbonates and polystyrene. In yet another embodiment, the photoconductive imaging member has an aryl amine that is N,N'-diphenyl-N,N'-bis(3-methylphenyl)-1,1'-biphenyl-4,4'-diamine.

Past efforts have been spent on developing repeatable and reproducible synthetic and purification methods that produce consistent hole-transporting polymers. A representative synthetic pathway is shown in the figure below:

In this case the polymer is a copolymer synthesized by reaction of N,N'-di-(3-hydroxyphenyl)-N,N'-diphenylbenzidine (DHTBD) with a mixture of bisphenol-A-bischloroformate and diethylene glycol bischloroformate. This mixture of co-monomers was selected to balance between rigidity and flexibility in the final polymer structure. While this is used an exemplary polymer, it is understood that this synthetic process can yield homopolymers and copolymers of infinite compositions through selection of a monomer or mixture of monomers, respectively. As used in the present disclosure, "TBD" is a common acronym for a class of compounds all having the skeleton of N,N,N',N'-tetraphenyl-4,4'-biphenyldiamine.

However, as discussed previously, there is a need to increase the speed at which current imaging members are able to operate. The current mobility composites described above, while suitable for their intended purposes, do not provide the desired charge mobility speed. The key measurement of speed of a imaging member's ability to move charge is its hole mobility, which is expressed either as a function of applied filed or as an mobility at a certain field.

It has been shown that a terphenyl-based arylamine, such as m-Butter (shown below), have hole mobility 2 to 5 times that

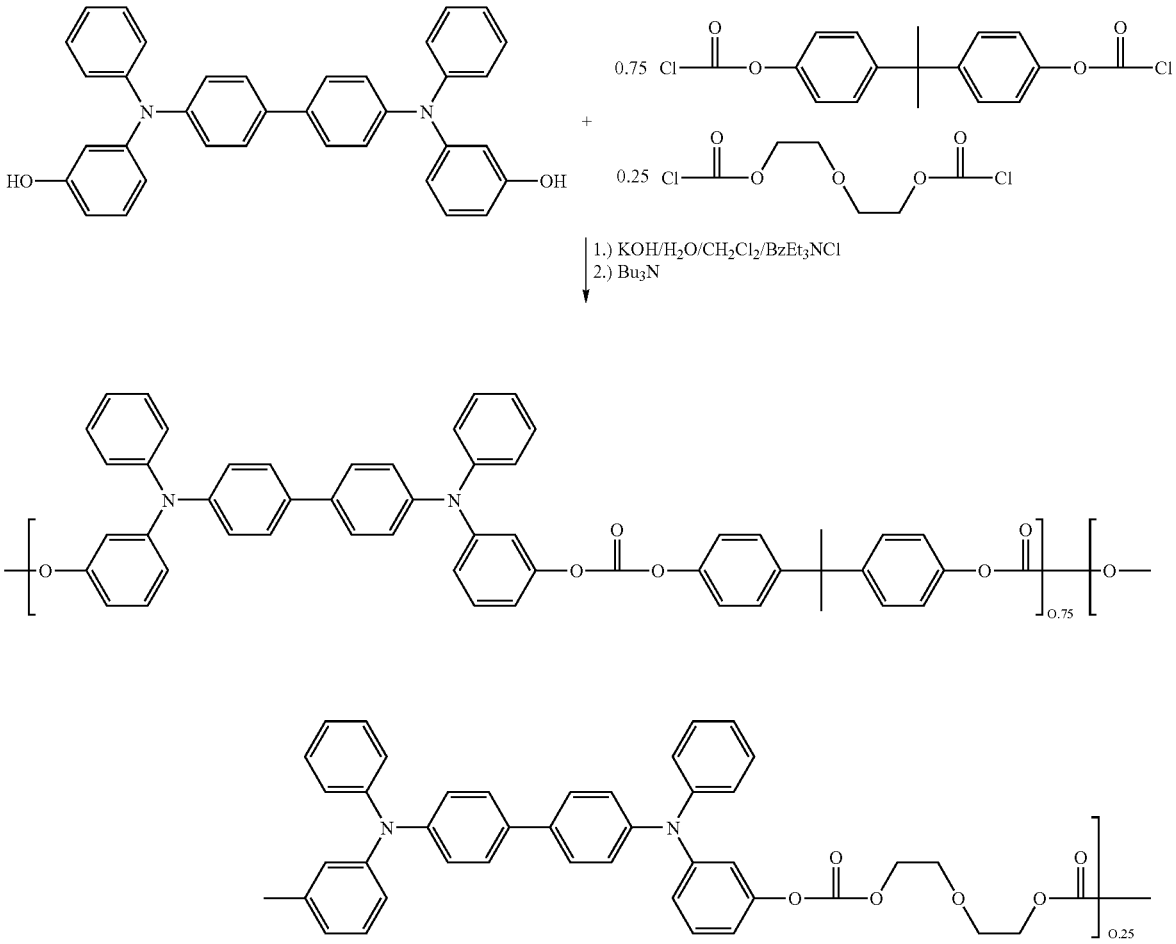

of the conventional N,N'-bis(3-methylphenyl)-N,N'-diphenyl-4,4'-benzidine at 50% weight.

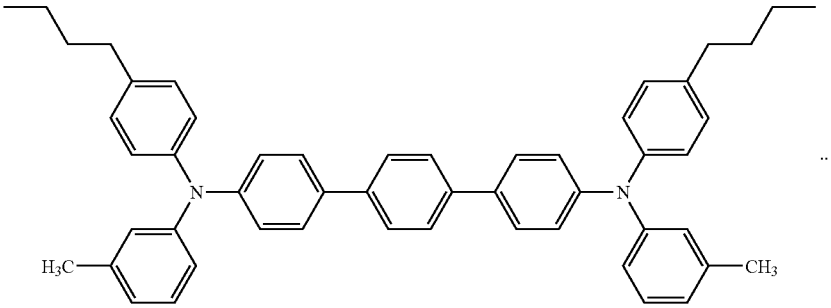

Another alternative to N,N'-bis(3-methylphenyl)-N,N'-diphenyl-4,4'-benzidine is a TPD based material, N,N,N'N'-(4-methylphenyl)benzidine. N,N,N'N'-(4-methylphenyl) benzidine, which also has shown slightly higher mobility than N,N'-bis(3-methylphenyl)-N,N'-diphenyl-4,4'-benzidine. N,N,N'N'-(4-methylphenyl)benzidine has exhibited about twice the mobility of that of N,N'-bis(3-methylphenyl)-N,N'-diphenyl-4,4'-benzidine, with the added advantages of extremely low residual voltage and extremely stable electrical cycling. The molecular structure of N,N,N'N'-(4-methylphenyl)benzidine is as follows:

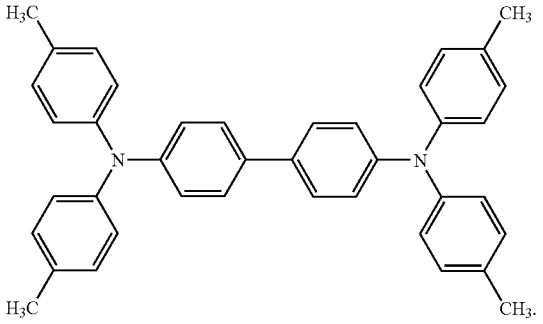

Figure 3:
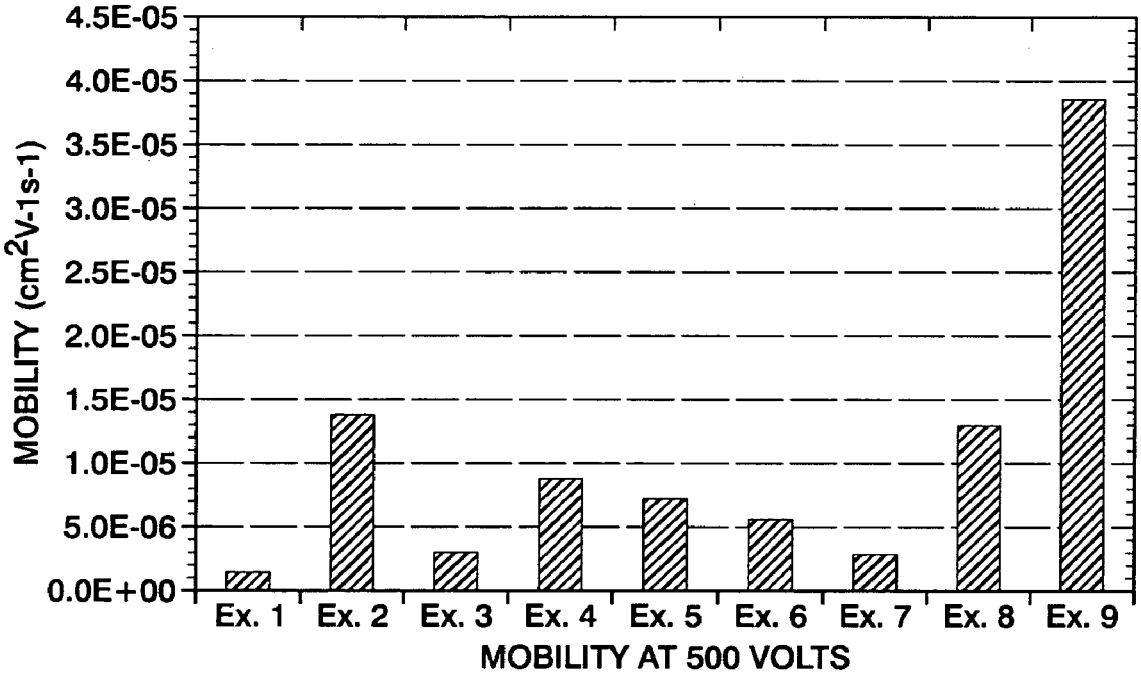
FIG. 3 is a comparison of the resulting mobility of CTLs incorporating the different transport molecules at 500V.
Figure 4:
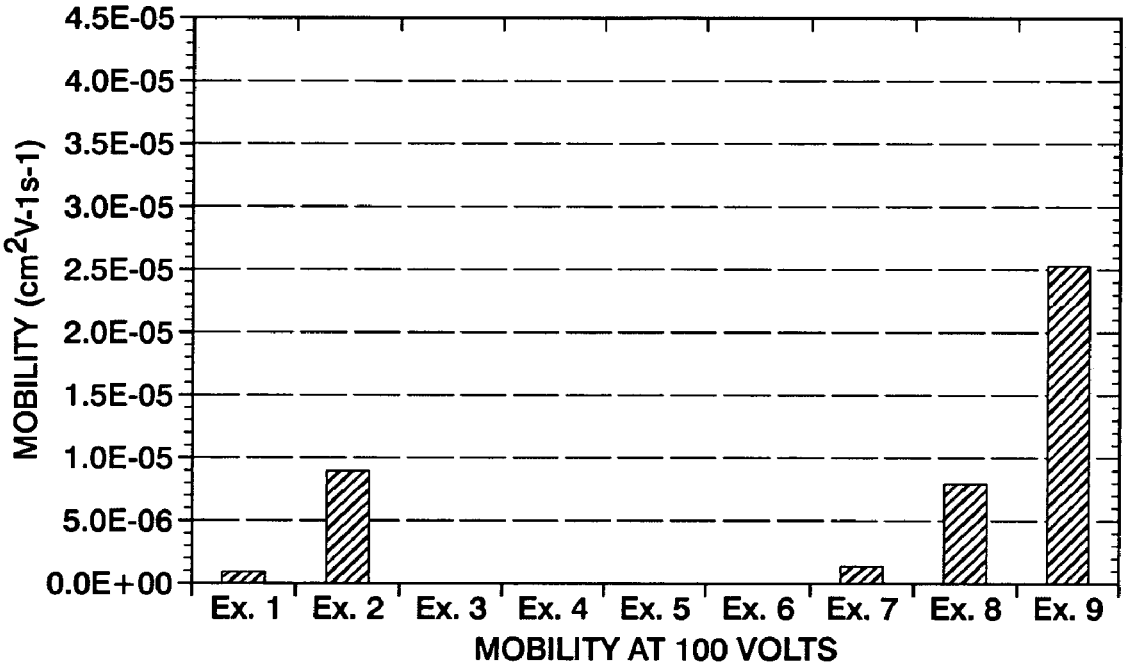
FIG. 4 is a comparison of the resulting mobility of CTLs incorporating the different transport molecules at 100V.

In present embodiments, a combination of a hole-transporting polymer and a terphyl-based arylamine have an unusually high hole mobility, far greater than the sum of their individual mobilities. This synergistic effect can be seen, for example, in the combination of a hole-transporting polymer based on DHTBD and a terphenyl-based arylamine (m-butter) which exhibits a mobility that is 16 to 20 times that of current imaging members (50%/mTBD:MAKROLON), whereas the individual hole-transporting polymer and the individual terphenyl-based arylamine has a mobility lower than that of current imaging members and a mobility of 2 to 5 times that of current imaging members, respectively. As noted above, the combination of N,N,N'N'-(4-methylphenyl)-4,4'-benzidine and a hole-transporting polymer also exhibits higher mobility than the combination of a hole-transporting polymer with N,N'-bis(3-methylphenyl)-N,N'-diphenyl-4,4'-benzidine, but only slightly. FIG. 3 shows a comparison of the resulting mobility of CTLs incorporating the different transport molecules at 500V. FIG. 4 shows a similar comparison at 100V. As can been seen, the CTLs incorporating m-butter exhibited much higher charge mobility than those incorporating the other transport molecules.

In embodiments, the terphenyl-based arylamine is present in the charge transport layer in an amount of about 5 percent to about 75 percent, or from about 25 percent to about 50 percent, by weight of the total weight of the charge transport layer. In embodiments, the hole-transporting polymer is present in the charge transport layer in an amount of about 25 percent to about 95 percent, or from about 50 percent to about 75 percent, of the total weight of the charge transport layer. In further embodiments, the charge transport layer comprises a ratio of the terphenyl-based arylamine to the hole-transporting polymer in an amount of about 5:95 or about 95:5.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB® AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the charge transport layer to the charge generating layer can be maintained from about 2:1 to 200:1, and in some instances as great as 400:1. The charge transport layer is substantially nonabsorbing to visible light or radiation in the region of intended use, but is electrically "active" in that it allows the injection of photogenerated holes from the photoconductive layer, that is the charge generating layer, and allows these holes to be transported through itself to selectively discharge a surface charge on the surface of the active layer.

Any suitable and conventional technique may be utilized to form and thereafter apply the charge transport layer mixture to the supporting substrate layer. Typical application techniques include, for example extrusion coating, draw bar coating, roll coating, wire wound rod coating, and the like. The charge transport layer may be formed in a single coating step or in multiple coating steps.

Drying of the deposited coating may be effected by any suitable conventional technique such as oven drying, infra red radiation drying, air drying and the like. The thickness of the charge transport layer after drying is from about 10 micrometers to about 40 micrometers or from about 24 micrometers to about 34 micrometers for optimum photoelectrical and mechanical results.

The Ground Strip Layer

Other layers such as conventional ground strip layer 45 including, for example, conductive particles dispersed in a film forming binder may be applied to one edge of the imaging member to promote electrical continuity to the conductive layer 12. The ground strip layer 45 may include any suitable film forming polymer binder and electrically conductive particles. Typical ground strip materials include those enumerated in U.S. Pat. No. 4,664,995, the entire disclosure of which is incorporated by reference herein. The ground strip layer 45 may have a thickness from about 7 micrometers to about 42 micrometers, for example, from about 14 micrometers to about 23 micrometers.

The Anti-Curl Back Coating

For ionographic imaging members, an electrically insulating dielectric imaging layer is applied to the electrically conductive surface. The substrate may contain an anti-curl back coating layer on the side opposite from the side bearing the charge transport layer or dielectric imaging layer to offset thermal contraction mismatch in the layers.

Generally, anti-curl back coating layers comprise a polymer and an adhesive dissolved in a solvent and coated on the reverse side of the active photoreceptor. The adhesive may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol. Any other suitable copolyesters may also be used. The anti-curl back coating layer must adhere to the polyethylenenaphthalate (PEN) substrate of the photoreceptor, for the life of the photoreceptor, while being subjected to xerographic cycling over rollers and backer bars within the copier or printer.

For electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member. If desired, the flexible belts disclosed herein may be used for other purposes where cycling durability is important.

The prepared flexible imaging belt may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The electrophotographic device can be evaluated by printing in a marking engine into which a photoreceptor belt formed according to the exemplary embodiment has been installed. For intrinsic electrical properties it can also be investigated by conventional electrical drum scanners.

All the patents and applications referred to herein are hereby specifically, and totally incorporated herein by reference in their entirety in the instant specification.

EXAMPLES

The examples set forth hereinbelow are being submitted to illustrate embodiments of the present disclosure. These examples are intended to be illustrative only and are not intended to limit the scope of the present disclosure. Also, parts and percentages are by weight unless otherwise indicated. Comparative examples and data are also provided.

Sample Preparation

Example I

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 0.7 grams N,N'-bis (3-methylphenyl)-N,N'-diphenyl-4,4'-benzidine with 1.3 grams MAKROLON® 5705 in 11.33 grams of methylene chloride. The charge transport layer was coated on the photogenerating layer using a web coating method in which a 3.5 inch 8-path applicator with a 10 mil gap was drawn across the device to deposit a charge transport layer having a thickness of about 25 micrometers. The charge transport coating was dried in a forced air Oven for about 1 minute at about 120° C.

Example II

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 1.0 grams N,N'-bis (3-methylphenyl)-N,N'-diphenyl-4,4'-benzidine with 1.0 grams MAKROLON® 5705 in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example III

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 2.0 grams of a polymer (synthesized by reaction of N,N'-(3-hydroxyphenyl)-N, N'-diphenylbenzidine (DHTBD) with diethylene glycol bischloroformate) in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example IV

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 2.0 grams of a copolymer (synthesized by reaction of dihydroxy-TBD, N,N'-di-(3-hydroxyphenyl)-N,N'-diphenylbenzidine (DHTBD) with a mixture of bisphenol-A-bischloroformate and diethylene glycol bischloroformate) in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example V

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 2.0 grams of a polymer (synthesized by reaction of N,N'-(3-hydroxyphenyl)-N, N'-diphenylbenzidine (DHTBD) with diethylene glycol bischloroformate) in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example VI

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 2.0 grams of a polymer (synthesized by reaction of N,N'-di-(3-hydroxyphenyl)-N,N'-diphenylbenzidine (DHTBD) with diethylene glycol bischloroformate) in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example VII

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 0.2 grams N,N'-bis (3-methylphenyl)-N,N'-diphenyl-4,4'-benzidine with 1.8 grams of a copolymer (synthesized by reaction of dihydroxy-TBD, N,N'-di-(3-hydroxyphenyl)-N,N'-diphenylbenzidine (DHTBD) with a mixture of bisphenol-A-bischloroformate and diethylene glycol bischloroformate) in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example VIII

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 0.7 grams N,N'-bis (3-methylphenyl)-N,N'-diphenyl-4,4'-benzidine with 1.2 grams of a copolymer (synthesized by reaction of dihydroxy-TBD, N,N'-di-(3-hydroxyphenyl)-N,N'-diphenylbenzidine (DHTBD) with a mixture of bisphenol-A-bischloroformate and diethylene glycol bischloroformate) in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example IX

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 1.0 grams N,N'-bis (3-methylphenyl)-N,N'-diphenyl-4,4'-benzidine with 1.0 grams of a copolymer (synthesized by reaction of dihydroxy-TBD, N,N'-di-(3-hydroxyphenyl)-N,N'-diphenylbenzidine (DHTBD) with a mixture of bisphenol-A-bischloroformate and diethylene glycol bischloroformate) hole transport polymer in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example X

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 1.0 grams N,N'-bis (3-methylphenyl)-N,N'-diphenyl-4,4'-benzidine with 1.0 grams of a copolymer (synthesized by reaction of dihydroxy-TBD, N,N'-di-(3-hydroxyphenyl)-N,N'-diphenylbenzidine (DHTBD) with a mixture of bisphenol-A-bischloroformate and diethylene glycol bischloroformate) in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example XI

A polyethylenenaphthalate substrate (PEN) metalized with a mixture of titanium and zirconium was supplied precoated with the following layers in succession: silane hole-blocking layer, an intermediate adhesive layer comprising Ardel and a charge transporting layer comprising Type IV hydroxygallium phthalocyanine dispersed in polycarbonate-Z binder polymer (PCZ-200). The formulation and coating of such layer is familiar to those skilled in the art. Over this supplied was coated a charge transporting layer. The charge transport layer was prepared by mixing 1.0 grams N,N'-bis (4-n-butylphenyl)-N,N'-bis(3-methylphenyl)-4,4"-diamino-p-terphenyl with 1.0 grams of a copolymer (synthesized by reaction of dihydroxy-TBD, N,N'-di-(3-hydroxyphenyl)-N,N'-diphenylbenzidine (DHTBD) with a mixture of bisphenol-A-bischloroformate and diethylene glycol bischloroformate) hole transport polymer in 11.33 grams of methylene chloride. The charge transport layer was coated on the photogenerating layer using a web coating method in which a 3.5 inch 8-path applicator with a 10 mil gap was drawnacross the device to deposit a charge transport layer having a thickness of about 25 micrometers. The charge transport coating was dried in a forced air oven for about 1 minute at about 120° C.

Example XII

Mobility Evaluation

Experimental method for determining mobility using Time-of-flight techniques is described in detail in the publication "Determination of Electronic and Optical Properties" Chapter 5 [Transient Photoconductor measurements] section 3.2. Authors Andrew R. Melnyk and Damodar M Pai.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An imaging member comprising:

a substrate;

a charge generating layer disposed on the substrate; and at least one charge transport layer disposed on the charge generating layer, the at least one charge transport layer comprising a high charge mobility composite comprising a terphenyl-based arylamine, and a hole-transporting polymer synthesized from N,N'-(3-hydroxyphenyl)-N,N'-diphenylbenzidine.

2. The imaging member of claim 1, wherein the terphenyl-based arylamine has the following formula:

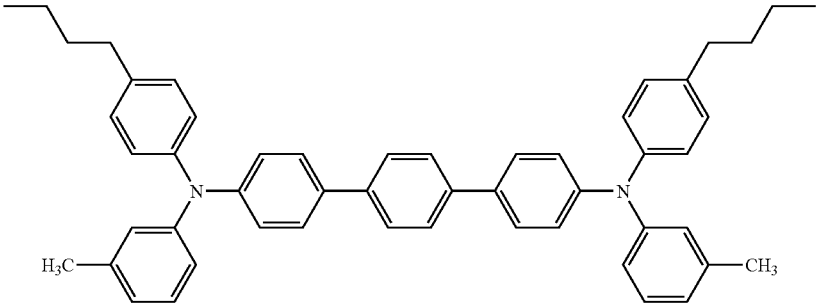

3. The imaging member of claim 1, wherein the hole-transporting polymer is a copolymer synthesized by a reaction between N,N'-(3-hydroxyphenyl)-N,N'-diphenylbenzidine, bisphenol-A-bischloroformate and diethylene glycol bischloroformate.

4. The imaging member of claim 1, wherein the terphenyl-based arylamine is present in the charge transport layer in an amount of about 5 percent to about 75 percent by weight of total weight of the charge transport layer.

5. The imaging member of claim 4, wherein the terphenyl-based arylamine is present in the charge transport layer in an amount of about 25 percent to about 50 percent by weight of total weight of the charge transport layer.

6. The imaging member of claim 1, wherein the hole-transporting polymer is present in the charge transport layer in an amount of about 25 percent to about 95 percent by weight of total weight of the charge transport layer.

7. The imaging member of claim 6, wherein the hole-transporting polymer is present in the charge transport layer in an amount of about 50 percent to about 75 percent by weight of total weight of the charge transport layer.

8. The imaging member of claim 1, wherein the charge transport layer comprises a ratio of terphenyl-based arylamine to hole-transporting layer of 5:95.

9. The imaging member of claim 1, wherein the charge transport layer comprises a ratio of terphenyl-based arylamine to hole-transporting layer of 95:5.

10. An imaging member comprising:

a substrate;

a charge generating layer disposed on the substrate; and at least one charge transport layer disposed on the charge generating layer, the at least one charge transport layer comprising a high charge mobility composite comprising a terphenyl-based arylamine having the following formula:

a hole-transporting polymer synthesized from N,N'-(3-hydroxyphenyl)-N,N'-diphenylbenzidine.

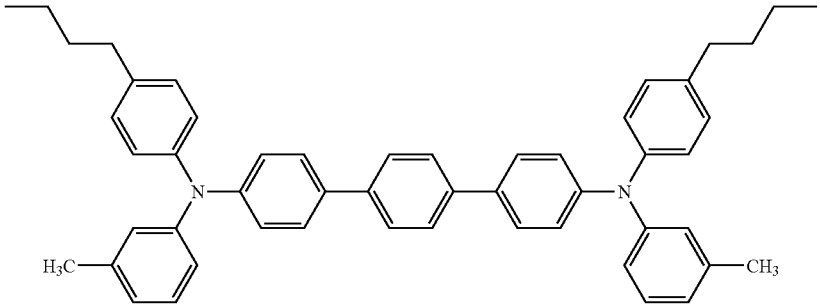

; and

11. An image forming apparatus for forming images on a recording medium comprising:

a) an imaging member of claim 1 having a charge retentive-surface for receiving an electrostatic latent image thereon, wherein the imaging member comprises a substrate, a charge generating layer disposed on the substrate, and at least one charge transport layer disposed on the charge generating layer, the at least one charge transport layer comprising a high charge mobility composite comprising a terphenyl-based arylamine, and a hole-transporting polymer synthesized from N,N'-(3-hydroxyphenyl)-N,N'-diphenylbenzidine;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

12. The image fanning apparatus of claim 11, wherein the terphenyl-based arylamine has the following formula:

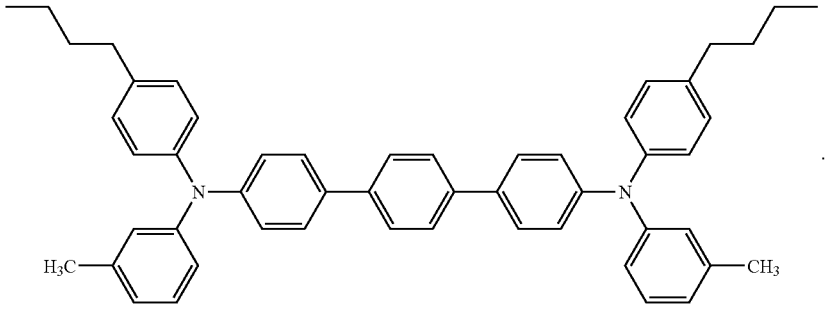

13. The image forming apparatus of claim 11, wherein the hole-transporting polymer is synthesized from N,N'-(3-hydroxyphenyl)-N,N'-diphenylbenzidine.

14. The image forming apparatus of claim 11, wherein the hole-transporting polymer is a copolymer synthesized by a reaction between N,N'-(3-hydroxyphenyl)-N,N'-diphenylbenzidine, bisphenol-A-bischloroformate and diethylene glycol bischloroformate.

15. The image forming apparatus of claim 11, wherein the terphenyl-based arylamine is present in the charge transport layer in an amount of about 5 percent to about 75 percent by weight of total weight of the charge transport layer.

16. The image forming apparatus of claim 15, wherein the terphenyl-based arylamine is present in the charge transport layer in an amount of about 25 percent to about 50 percent by weight of total weight of the charge transport layer.

17. The image forming apparatus of claim 11, wherein the hole-transporting polymer is present in the charge transport layer in an amount of about 25 percent to about 95 percent by weight of total weight of the charge transport layer.

18. The image forming apparatus of claim 11, wherein the charge transport layer comprises a ratio of terphenyl-based arylamine to hole-transporting layer of 5:95.

19. The image forming apparatus of claim 11, wherein the charge transport layer comprises a ratio of terphenyl-based arylamine to hole-transporting layer of 95:5.

20. An imaging member comprising:

a substrate;

a charge generating layer disposed on the substrate; and at least one charge transport layer disposed on the charge generating layer, the at least one charge transport layer comprising a high charge mobility composite comprising a charge transport aryl amine having the following formula:

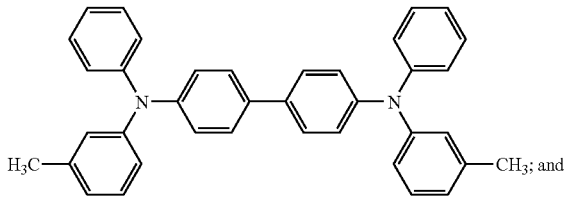

a hole-transporting polymer synthesized from N,N'-(3-hydroxyphenyl)-N,N'-diphenylbenzidine.

* * * * *